United States Patent [19]

Livne

[11] Patent Number: 4,620,484

[45] Date of Patent: Nov. 4, 1986

[54] PRACTICE BOMB

[75] Inventor: Zvi Livne, Shavei Zion, Israel

[73] Assignee: Polyzive, Western Galilee, Israel

[21] Appl. No.: 710,538

[22] Filed: Mar. 11, 1985

Related U.S. Application Data

[63] Continuation of Ser. No. 418,984, Sep. 16, 1982, abandoned.

[30] Foreign Application Priority Data

Oct. 26, 1981 [IL] Israel ..... 64109

[51] Int. Cl.[4] ..... F42B 25/18

[52] U.S. Cl. ..... 102/395; 102/529

[58] Field of Search ..... 102/395, 498, 529

[56] References Cited

U.S. PATENT DOCUMENTS

| | | | |
|---|---|---|---|
| 1,285,083 | 11/1918 | Eskesen | 102/395 |
| 1,920,257 | 8/1933 | Halland | 102/395 |
| 2,354,039 | 7/1944 | Mitchell | 102/395 |
| 3,343,486 | 9/1967 | Patrick | 102/395 |
| 3,379,131 | 4/1968 | Webb | 102/395 |
| 3,687,398 | 8/1972 | Beuschel | 102/498 X |
| 3,976,009 | 8/1976 | Delgado et al. | 102/395 |
| 4,112,843 | 9/1978 | Laviolette | 102/395 |
| 4,446,794 | 5/1984 | Simmons | 102/498 X |

FOREIGN PATENT DOCUMENTS

| | | | |
|---|---|---|---|
| 1063427 | 10/1979 | Canada | 102/529 |
| 0007695 | 2/1980 | European Pat. Off. | 102/529 |

*Primary Examiner*—David H. Brown
*Assistant Examiner*—John E. Griffiths
*Attorney, Agent, or Firm*—Browdy and Neimark

[57] ABSTRACT

A practice bomb comprised of a hollow two piece plastic shell having lug assemblies therein which aid in retaining the shell halves together notwithstanding the large stresses and strains placed on the bomb during its flight and launching and also releasably suspend the bomb during the transportation of the bomb to the target.

9 Claims, 11 Drawing Figures

PRACTICE BOMB

FIELD OF THE INVENTION

The present invention is concerned with armament devices used during training and more particularly with practise bombs for use in practising bombing by airplanes.

This application is a continuation of application Ser. No. 418,984, filed Sept. 16, 1982, now abandoned.

BACKGROUND OF THE INVENTION

It is known to use practise bombs for, training airforce personnel for actual bombing runs. It is also known to use the practise bombs for practising bombing runs. Originally practise bombing was done with live bombs. However besides being unduly expensive this method of practising is also inherently more dangerous than using dummy bombs. Therefore most of the practise bombing is now done with dummy or practise bombs.

It is no longer necessary for the dummy bombs to have the same weight as the real bombs. Pertinent data such as the trajectory and weight of the bomb is entered into the bomb sight computer; and therefore the pilot's actions are the same whatever the weight. The information is in the computer and the bomb release is guided according to the information in the computer Thus it is only necessary that the computer know the correlation between actual bombs and practise bombs.

Until very recently the practise bombs were made of steel. Thus although less expensive than real bombs, they were still relatively expensive and even of greater concern than the expense was the weight of the bombs which made handling and transportation difficult and costly. More recently practise bombs have been fabricated from such materials as fibre glass and/or composites including plastic and metals in combination. These bombs too are relatively expensive and heavy although less expensive and heavy than the steel bombs.

The more expensive the practise bomb the less apt airforces are to use the bombs in practice. The heavier the bomb the harder it is to handle, the more likelihood there is for accidents during the handling of the bombs, and the more expensive it is to ship from the place of manufacture to the site where the bomb is attached to the airplane.

Practise bombs usually have hollow bodies and are shipped empty to reduce the cost of shipping. They are filled with water when attached to the airplanes to add weight. These practise bombs take tremendous stresses and strains during the flight and during the release. In the flights some of the stresses that are placed on the practise bomb occur because of the high accelerations both at take-off and on manoeuvres such as tight turns, dives and climbs during the flight. In addition, during release a high impact device hits the bomb to force it away from the wing. This is necessary because otherwise the bomb immediately of launching has a tendency to rise and strike the wing causing damage to the airplane if not actually destroying the airplane. Therefore a piston hits the bomb as it is released with a high impact forcing it away from the airplane.

It is because of the high stresses and impacts that high grade material has been used in the prior art dummy bombs. Thus, those skilled in the art in the past have used high grade heavy and costly materials for fabricating the dummy or practise bombs instead of less costly material.

SUMMARY OF THE INVENTION

Accordingly it is an object of the present invention to provide new and improved practise bombs in which the above referred to disadvantages are substantially reduced or overcome.

According to the present invention practise bombs for training airforce personnel in the use of actual bombs are provided, said practise bombs comprising a hollow shell shaped to approximate the shape of an actual bomb, suspension means for suspending said bombs from airplanes, said suspension means comprising means integral to said hollow shell, impact receiving means mounted to said hollow shell for receiving the impact of a bomb launching mechanism, and said hollow shell fabricated from relatively inexpensive thermoplastic material.

A feature of the invention and a synergistic effect related to the material used to fabricate the dummy bomb is that the dummy bomb being fabricated in two half shells can be welded together to form a watertight container.

Yet another feature of the invention are the lug assemblies and the construction of the lug assemblies it used for attaching the bomb to the release mechanism of the airplane. The lug assemblies include lug units that are basically composites featuring actual metallic loops and plastic anchors for the loop. A unique composite arrangement is used to obtain the strength to withstand the abovementioned stresses on the bomb both during the flight and during the release process.

Yet another feature of the invention is the lug assembly in the bomb itself which also acts to strengthen the bomb by spreading the stresses placed on the bomb during the flight and the release process.

Yet another feature of the bomb is the impact plate used for receiving and spreading the impact shock.

BRIEF DESCRIPTION OF THE DRAWINGS

The operation and the utilization of the present invention will be more fully apparent from the description of a preferred embodiment taken in conjunction with the following drawings, in which.

GENERAL DESCRIPTION

Figure 1:
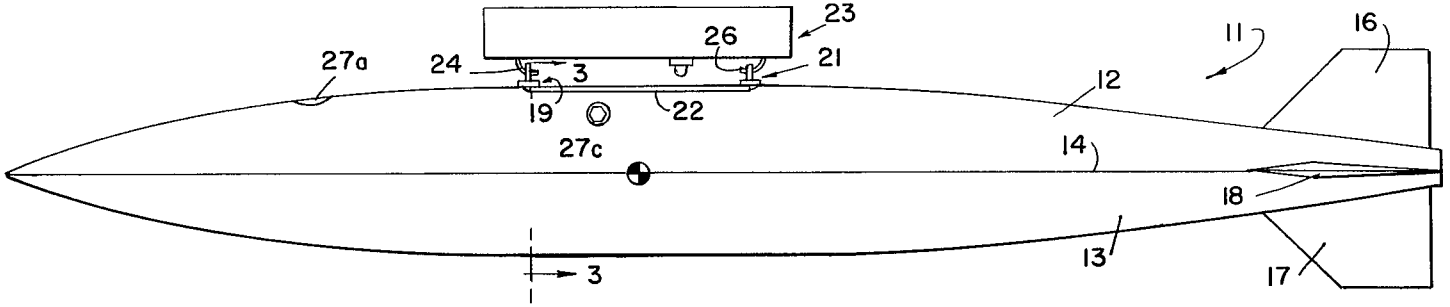
FIG. 1 is a side view of the inventive dummy bomb schematically shown attached to an airplane release system.

While practise bombs do not have to have the same weight as the actual bombs they approximate the shape of the actual bombs and have sufficient weight to provide a trajectory that is similar to the actual bomb and thus give the pilot being trained the "feeling" of the actual bomb. One of the most important criteria of the practise bombs is similarity between bombs; that is, a series of bombs should follow pretty much the same trajectory and provide the trainee with devices that will give similar results. To this end the bombs should be perfectly watertight so that the weight put into the computer is the actual weight of the bombs. To be watertight they have to have a watertight seal.

A preferred embodiment of the practise bomb 11 is fabricated from an upper shell section 12 and a lower shell section 13. The sections are split around a longitudinal equator 14. The sections are welded together along this equator 14. The bomb is shown as comprising fins such as fins 16, 17 and 18 for giving it the proper aerodynamic characteristics.

Means are provided for suspending the bombs from the airplane. More particularly a pair of suspension lug assemblies 19 and 21 are shown. Between the suspension assemblies there is shown means for withstanding the impact of impact mechanisms used in the release mechanism of the airplane. That means is shown as impact plate 22.

Also generally shown in a schematic fashion is the release mechanism of the airplane 23 which holds the bomb suspended until it is released. The release suspension mechanism includes hooks extending from the airplane such as hooks 24 and 26 which cooperate with suspension lug assemblies 19 and 21 respectively.

Figure 2:
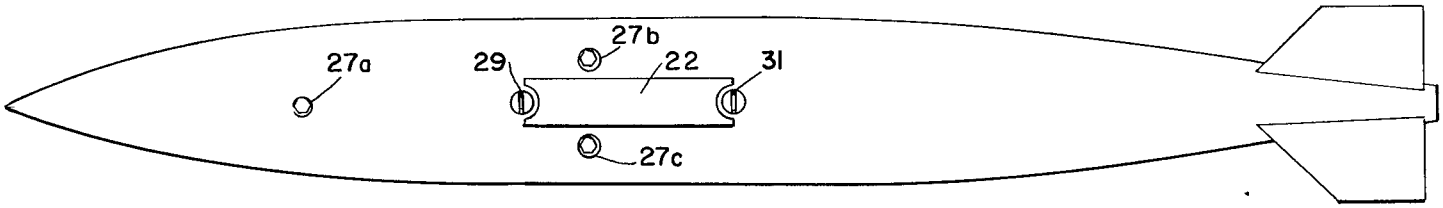
FIG. 2 is a plan view of the bomb of FIG. 1.

Both FIGS. 1 and 2 show filling caps 27*a*, 27*b* and 27*c* through which water or other filler is placed into the hollow body assembly. The placement of the caps enables filling the bomb in all typical bomb rack mounting positions.

The bomb in a preferred embodiment is made of a relatively inexpensive plastic not known for its structural strength. Accordingly, those skilled in the art have until now not used the plastic used herein for bombs or other devices that undergo high stresses. More particularly the plastic in the preferred embodiments is a glass reinforced structural foam polyethylene which has a low specific gravity. One synergistic effect derived from the use of this inexpensive plastic is that the two half sections can be welded together to form an integral shell and the weld is absolutely watertight. Means are provided for reinforcing and strengthening the relatively inexpensive plastic such as, for example, the lug suspension means. Thus the lug suspension means provides both suspension and structural strengthening of the plastic dummy bombs.

Figure 3:
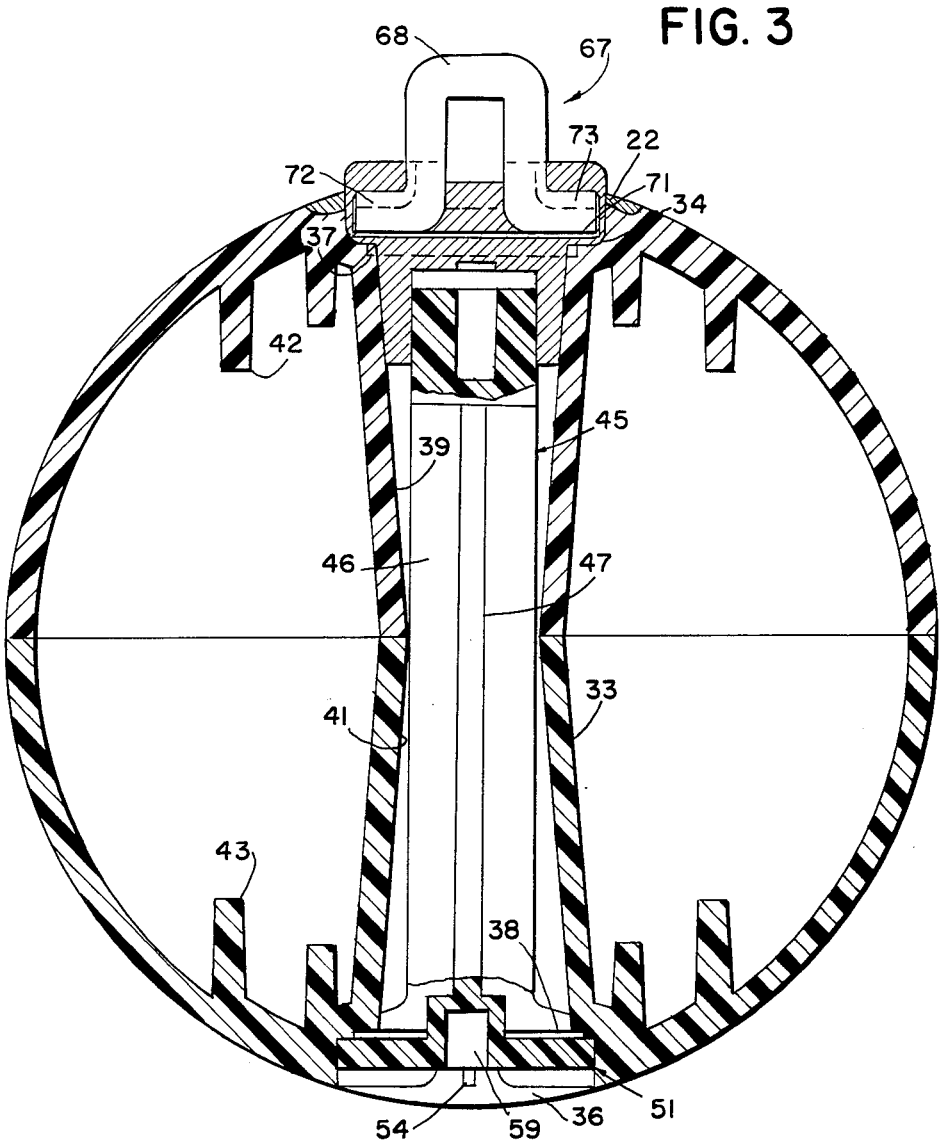
FIG. 3 is a sectional view of the bomb shell and lug assembly taken where the bomb is attached to the bomb release mechanism of the airplane.

In FIG. 3 the structure of the shell halves is shown in the sectional view. Here there is shown a seat arrangement which is part of the lug suspension assembly. The seat arrangement includes a truncated cone in each half section of the shell. The seat arrangement incidentally is symmetrical about the mid-point in both directions. The top half section comprises a truncated cone 32 and there is a corresponding truncated cone 33 on the lower half of the bomb as seen in the cross-sectional view of FIG. 3. The truncated conical sections serve to provide compression strength not otherwise inherent in the structure of the shell. The truncated sections also serve as part of the suspension assembly. The top of each of the truncated cones 32, 33 are seats 34 and 36 respectivel y. The seats are enlarged hollowed out cylindrical cross-sections at the top and bottom respectively of the bombs.

The top of the cylindrical cross-section of the bomb is shown in FIG. 3. Immediately radially inward from each of the cylindrical seat sections 34 and 36 is a smaller diameter short cylindrical section 37 and 38 respectively. The largest portion of the truncated cones is immediately radially inward from the smaller cylindrical sections 37 and 38. The smallest portion of the truncated cones is at 39 and 41 where the truncated cones are joined together and forms substantially cylindrical bores through the cylindrical cross-section of the bomb shown in FIG. 3.

It should be noted that within the scope of this invention the conical sections can also be cylindrical or assume other shapes.

Means are provided for enhancing the flexural resistance of the bomb body more particularly ribs are provided as it is well known to those skilled in the art such as, for example, top rib 42 and bottom rib 43.

Each of the lug suspension assemblies are substantially identical both having the same seat and conical section arrangements. The seats and cones are designed to receive the suspension lugs 44.

Figure 8:
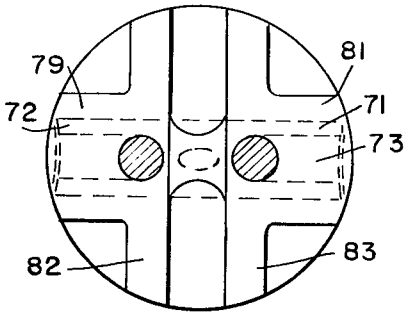
FIG. 8 is a bottom view of the loop assembly.

The suspension lugs comprise a lower part and an upper part. The lower part is shown in detail in FIGS. 4 to 6 while the upper part is shown in detail in FIGS. 7 to 9.

Figure 4:
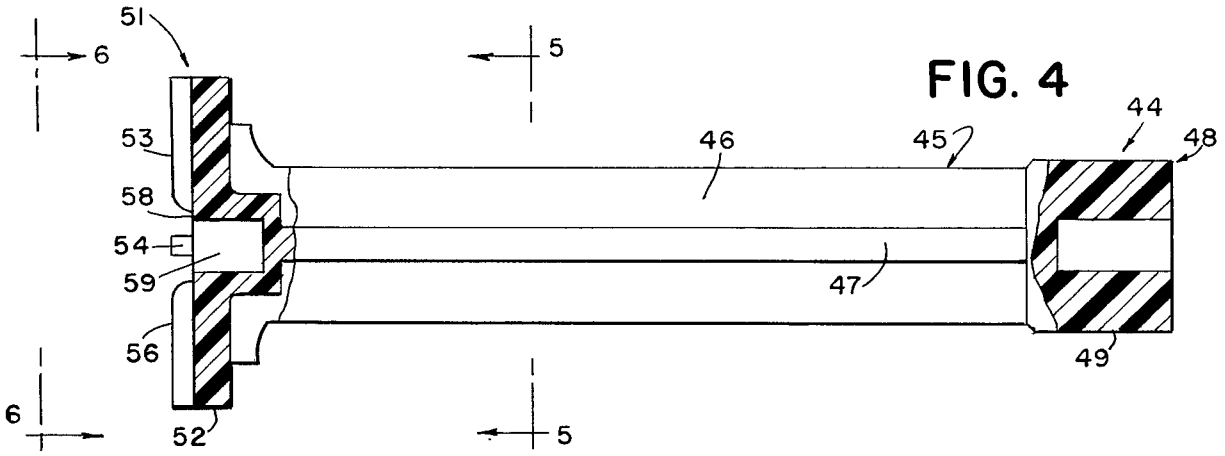
FIG. 4 is a partial sectional side view of the suspension lug of the lug assembly used in the bomb body.
Figure 6:
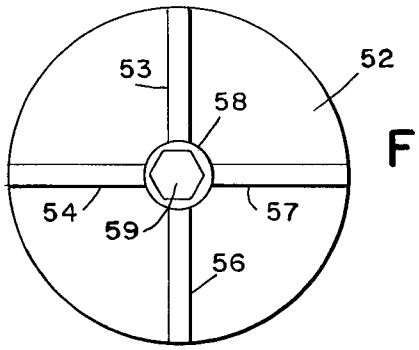
FIG. 6 is a top view of the suspension lug of FIG. 4 at plane 6—6 and looking in the direction of the arrows.
Figure 5:
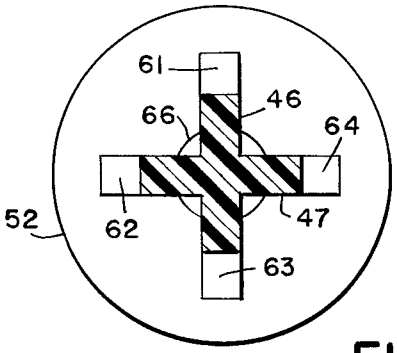
FIG. 5 is a sectional view of the suspension lug of the lug assembly of FIG. 4 taken at plane 5—5 and looking in the direction of the arrows.
Figure 7:
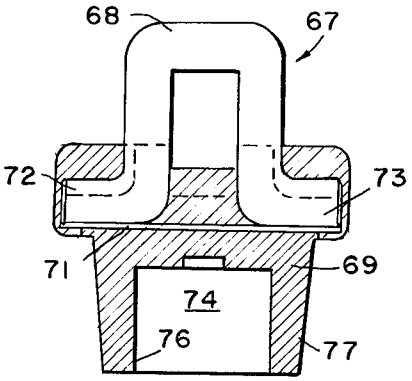
FIG. 7 is a sectional view of a loop assembly used as part of the suspension lug.

Turning now to FIGS. 4–6, the suspension lug lower part is shown as comprising a main body section 45 which in cross-section comprises cruciform shaped orthogonal vanes 46 and 47. One end of the body terminates in a threaded section 48 having external threads at 49. The threaded section 48 is basically cylindrical and extends for a fixed length. The other end of the body 45 terminates in an enlarged section 51. Section 51 comprises a cylindrical portion 52 shown with four orthogonal vanes 53, 54, 56 and 57 radiating from a central circular cavity portion 58. Within the cavity portion is a hexagonal cavity 59. The vanes of the main body section extend where they meet the cylinder 52 into vane terminating sections 61, 62, 63 and 64. The main vane portions 46 and 47 have a smaller diameter than the extended terminating sections of the vanes. Where the vanes adjoin the cylinder 52 there is a small cylindrical section 66.

The main vane sections are slightly smaller than the small portions 39 and 41 of the truncated conical sections 32 and 33 and similarly the cylindrical section 52 is slightly smaller than the seat section 36. Likewise the extended vane section is approximately the size of the large portion of the conical cylinder immediately below the small cylinder 38. The size differentials enables the suspension lug lower part, shown in FIGS. 4, 5 and 6 to rotate in the truncated cones 32 and 33 responsive to being turned with a hex headed key placed into the hexagonal aperture 59.

The lower part of the suspension lug is placed with the large section 51 at the bottom of the bomb, fitting into seat 36 with the cylindrical section 48 extending up into the seat section 34, for assembly with the upper part of the suspension lug. The lower part of the suspension lug in a preferred embodiment is made from nylon plus approximately 60% glass fibers.

The upper part of the suspension lug assembly 67 comprises a loop portion 68 molded into the plastic base portion 69. A metal plate 71 is fastened to the loop portion 68 by means such as welding to provide additional tension strength to the assembly 67. The base section 69 has an aperture 74 defined by threaded internal cylindrical walls 76. The external walls 77 of the base section 69 define a truncated cone which matches the truncated cone of the actual bomb shell portion.

Figure 9:
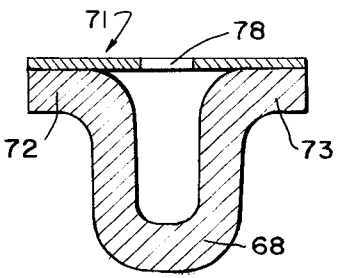
FIG. 9 is a sectional view of the actual loop and metal insert of the loop assembly.

The loop portion 67 is an assembly comprising the loop 68. The loop 68 comprises the U-shaped section with legs 72 and 73 welded to the metal insert 71. The metal insert has a hole therethrough at 78 which enables the uniform and unitary plastic formation of the base portion 69. This adds tensile strength to the assembly 67. The metallic plate insert 71 is also seen in FIG. 9 which is the bottom view of the upper part of the suspension lug assembly 67. In the top view of the suspension lug upper part that is in FIG. 8 there is seen the leg supporting sections 79 and 81 which receive hold and maintain legs 72 and 73 in the base portion. Also shown are the rib sections 82 and 83 extending transverse to the legs supporting sections 79 and 81. The ribs 82 and 83 are separated by a space which enables the hooks of the airplane to reach into the loop without any interference.

The upper part of the suspension lug 67 is placed into the upper seat portion 34 with the lower part of the suspension lug assembly placed into seat section 36 and extending up into seat section 34. The hexagonal key wrench is placed into the hexagonal cavity 59 to turn the lower part of the suspension lug assembly until the outer threads 49 mesh with the inner threads 76 of the upper section and the two parts are pulled together until there is compression on the suspension lug assembly. This is done in both suspension lug assemblies. The compression aids the units to withstand the tensile forces that occur while the bomb is being carried by the plane in flight.

Figure 10:
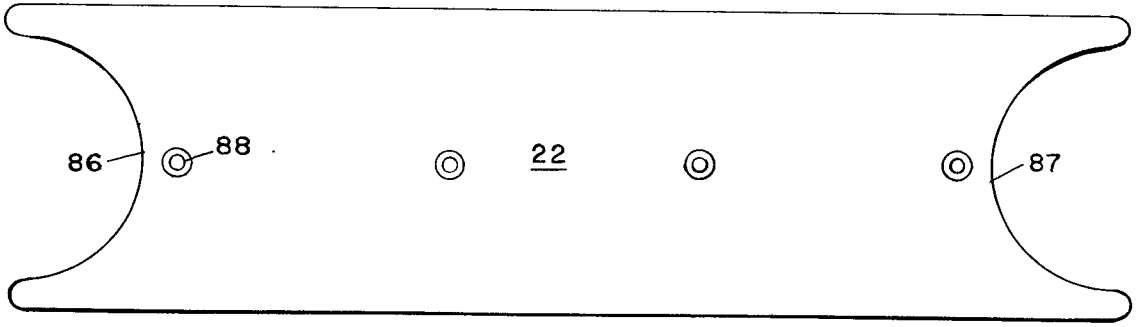
FIG. 10 is a plan view of the impact plate used on the practise bomb.

Between the suspension assembly there is shown an impact plate 22. The impact plate is shown in greater detail in FIGS. 10 and 11. As seen in FIG. 10 the impact plate is substantially rectangular with arcuate sections removed from the longitudinal ends 86 and 87 of plate 22.

Figure 11:
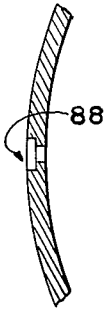
FIG. 11 is a side view of the plate of FIG. 10.

The plate as best seen in FIG. 11 has a basically arcuate cross-section with apertures therein such as aperture 88 for receiving fasteners to fasten the plate to the bomb shell. During the molding process the plate is placed directly in the mold and is molded into the upper half shell. This is shown in FIG. 3 where the plate 22 is shown in invisible line form. The plate because of its position and the arcuate sections 86 and 87 which enable the plate to extend between and partially surround each of the suspension assemblies distributes the impact forces along its entire surface essentially through the suspension assemblies.

In operation the bomb is molded of relatively inexpensive material and fabricated of two half shells which are welded together to form a watertight bomb shell. The suspension lugs are inserted, the bottom half being inserted from the bottom, the upper half from the top and the suspension lugs are threaded together until there is compression exerted by the suspension lugs.

The cones which are part of the suspension assembly provide for additional strength against compression forces while the lugs themselves provide strength against the relative high tension forces exerted on the bomb. Thus, a lightweight reliable plastic bomb made from inexpensive material is provided that enables bombing runs with consistent and similar results. Thus there is provided a reliable light extremely consistent practice bomb. The bomb being lightweight is easily transported, easily handled and attached to the release mechanism of the airplane. After being attached to the release mechanism, the bomb is filled with water. During flight the bomb is capable of withstanding the tremendous stresses placed thereon.

While the principles of the invention have been described above in connection with specific apparatus and applications, it is to be understood that the description is made by way of example only and not as a limitation on the scope of the invention.

What is claimed is:

1. A practice bomb for use in training personnel to use actual bombs, said practice bomb comprising:

a substantially hollow watertight body of foamed glass reinforced plastic material shaped to approximate the entire outer shape of an actual bomb, said body including at least two hollow cylindrical seat sections which are spaced apart in each of top and bottom half sections of said body, from said seat sections, means defining bores extend inwardly and are joined therein so as to form at least two bores through said top and bottom half sections, while maintaining the body watertightness, said means defining bores providing said practice bomb with resistance to compression forces;

two separate lug suspension means each including an upper part and a lower part, said upper part including a loop portion adapted to accommodate a hook from a bomb suspension mechanism aboard an airplane, said loop portion molded into a base portion having an aperture defined by threaded internal cylindrical walls and by external walls insertable into said bores, said lower part including a main section, a threaded section on one end thereof, and an enlarged section on another end thereof, said threaded section and the main section extending through one of said bores for threadably engaging the threaded internal cylindrical walls of said upper part with said threaded section as said enlarged section is rotated whereby said lower part pulls said upper part toward said body and secures said lug suspension means to said body; and impact means fixedly connected to said body for receiving the impact of a bomb launching mechanism on said airplane.

2. The practise bomb of claim 1, wherein said hollow body comprises substantially two half sections of the said body, said half sections being joined together to form a waterproof hollow body.

3. The practise bomb of claim 2, wherein said body is split longitudinally to form said half sections, and wherein said half sections are joined together at an equator line.

4. A practice bomb as recited in claim 1 wherein said impact means is a metal plate conforming to the curvature of said practice bomb whereat the plate is fixed thereto.

5. A practice bomb as recited in claim 4 wherein each loop portion is of metal and essentially in the shape of an inverted U, with the loop portion partially embedded in the base portion of the upper member parts of the lug suspension means.

6. A practice bomb as recited in claim 1 wherein the body is of foamed glass reinforced high density polyethylene.

7. A practice bomb as recited in claim 6 wherein said lug suspension means are spaced apart from one another with said impact means therebetween.

8. A practice bomb as recited in claim 6 wherein said impact means is a metal plate conforming to the curvature of said practice bomb whereat the plate is fixed thereto.

9. A practice bomb as recited in claim 8 wherein each loop portion is of metal and essentially in the shape of an inverted U, with the loop portion partially embedded in the base portion of the part of the lug suspension means.

* * * * *